US008991601B2

(12) United States Patent
Torikai et al.

(10) Patent No.: US 8,991,601 B2
(45) Date of Patent: Mar. 31, 2015

(54) PLATE-SHAPED MEMBER HOLDING SYSTEM, PLATE-SHAPE MEMBER PACKING DEVICE, AND METHOD FOR HOLDING A PLATE-SHAPED MEMBER

(75) Inventors: Hideaki Torikai, Tokyo (JP); Masayasu Sato, Tokyo (JP); Tomonori Koyama, Higashikagawa (JP); Koichiro Okamura, Higashikagawa (JP)

(73) Assignee: Asahi Glass Company, Limited, Tokyo (JP)

( * ) Notice: Subject to any disclaimer, the term of this patent is extended or adjusted under 35 U.S.C. 154(b) by 958 days.

(21) Appl. No.: 12/254,486

(22) Filed: Oct. 20, 2008

(65) Prior Publication Data

US 2009/0090652 A1 Apr. 9, 2009

Related U.S. Application Data

(63) Continuation of application No. PCT/JP2007/058207, filed on Apr. 13, 2007.

(30) Foreign Application Priority Data

Apr. 20, 2006 (JP) ..... 2006-117131

(51) Int. Cl.
*B65D 85/48* (2006.01)
*B65D 25/10* (2006.01)
*B65D 81/02* (2006.01)

(52) U.S. Cl.
CPC ..... *B65D 85/48* (2013.01); *B65D 25/103* (2013.01); *B65D 81/02* (2013.01)
USPC ..... 206/453; 206/449; 206/477; 206/586; 206/448

(58) Field of Classification Search
USPC ..... 206/587, 583, 448, 453–456, 449, 451, 206/806, 452, 594, 586; 248/316.1, 74.1
See application file for complete search history.

(56) References Cited

U.S. PATENT DOCUMENTS 2,919,022 A * 12/1959 Lidgard ..... 206/448
3,043,488 A 7/1962 Warwick
3,044,615 A * 7/1962 Richardson ..... 206/448
3,451,169 A * 6/1969 Bell et al. ..... 49/462

(Continued)

FOREIGN PATENT DOCUMENTS

JP 10-264979 A 10/1998

*Primary Examiner* — Mickey Yu
*Assistant Examiner* — Chun Cheung
(74) *Attorney, Agent, or Firm* — Oblon, McClelland, Maier & Neustadt, L.L.P.

(57) ABSTRACT

The present invention provides a plate-shaped member holding system, which stably holds a plate-shaped member without damage during transportation.
The plate-shaped member holding system includes a holder for holding a glass sheet as a plate-shaped member and a fixing member engageable with the holder. The holder includes a pair of retainers for clamping the plate-shaped member from both sides of a front side and a rear side thereof, a pair of supports for supporting the retainers, and a coupler for coupling the paired supports. When the holder is engaged with an engagement recess formed in the fixing member with the plate-shaped member being disposed between the paired supports, the holder utilizes the weight of the plate-shaped member to generate pressing forces in directions to bring the paired retainers much closer to each other so as to firmly clamp and stably holds the plate-shaped member by the paired retainers.

17 Claims, 14 Drawing Sheets

(56) References Cited

U.S. PATENT DOCUMENTS 5,094,903 A * 3/1992 Elzey ..... 428/192
5,101,976 A * 4/1992 Salisbury ..... 206/454
5,762,194 A * 6/1998 Clegg ..... 206/449
7,458,465 B1 * 12/2008 Dahl et al. ..... 206/592

* cited by examiner (A)

(B)

(C)

(A)

(B)

(A)

(B)

(A)

(B)

(A)

(B)

(A)

(B)

PLATE-SHAPED MEMBER HOLDING SYSTEM, PLATE-SHAPE MEMBER PACKING DEVICE, AND METHOD FOR HOLDING A PLATE-SHAPED MEMBER

TECHNICAL FIELD

The present invention relates to a plate-shaped member holding system, a plate-shape member packing device, and a method for holding a plate-shaped member, which are capable of stably holding a plate-shaped member out of contact with its surroundings to prevent it from being damaged during transportation.

BACKGROUND ART

When a plate-shaped member, such as a glass sheet formed as a plate, is transported, it is required not only to protect the plate-shaped member in order to prevent it from being damaged during transportation but also to hold the plate-shaped member in a stable state even if vibration is applied from outside during transportation. In a conventional method for holding a plate-shaped member, retainers made of a foamed polystyrene material are brought into contact with substantially central portions of a front side and a rear side of a plate-shaped member, and a pair of plate-shaped holders made of wood is disposed on both sides of the plate-shaped member. Opposite ends of the paired retainers, which are disposed in parallel so as to clamp the retainers, are coupled with metal stoppers to hold the plate-shaped member (see, e.g. Patent Document 1).

Patent Document 1: JP-A-10-264979

DISCLOSURE OF THE INVENTION

Problems that the Invention is to Solve

However, in the above-mentioned conventional holding method, the wood members and the metal members are combined together to firmly hold the front and rear sides of a plate-shaped member by clamping the retainer in a pressing state by the plate-shaped holders as the wood member. The holding system itself is quite heavy, causing a problem in that operations for housing a plate-shaped member into a box with the plate-shaped member held by the holding system and for taking the plate-shaped member out of the box require much labor, imposing a great burden on workers.

From this point of view, it has been demanded to stably hold a plate-shaped member by a plate-shaped member holding system that is made simpler and lighter.

Further, in particular, a glass sheet for vehicles have been generally assembled to a vehicle body as an assembly with plural parts combined. For this reason, a plate-shaped member, such as a glass sheet for vehicles, has a deformable part, such as a molding, fitted to a peripheral edge thereof in many cases. It has been more important to provide a system for not only transporting a plate-shaped member without damaging it but also transporting a plate-shaped member configured as an assembly without deforming parts mounted to the plate-shaped member.

In the conventional holding system, the respective parts are made of different materials, and the respective parts must be collected for recovery, being independent from one another. This causes a problem in that the recovering work for the holding system after taking a plate-shape member out of a box is troublesome, making the reuse of the holding system difficult.

In consideration of the above-mentioned circumstances, it is an object of the present invention to provide a plate-shaped member holding system, a plate-shape member packing device, and a method for holding a plate-shaped member, which are capable of solving the above-mentioned problems.

Means of Solving the Problems

In order to attain the above-mentioned object, the present invention provides the following solutions:

The present invention attains the object by providing a plate-shaped member holding system comprising a holder and a fixing member, the holder including a pair of retainers for clamping a plate-shaped member from both sides of a front side and a rear side thereof and a pair of supports for supporting the retainers; the fixing member comprising an engagement recess engageable with the supports; and the paired support being configured to be pressed in directions to be brought closer to each other in a course of being put into the engagement recess, whereby the paired retainers hold the plate-shaped member from both sides of the front and rear sides.

The present invention also attains the object by providing a plate-shaped member holding system, wherein the engagement recess has contacting surfaces configured to be brought into contact with outer sides of the paired supports at an angle, and/or the supports have tapered portions configured to be brought into contact with inner surfaces of the engagement recess at an angle, and wherein the paired retainers are configured to be pressed in directions to be brought closer to each other by utilizing a relative difference and a relative contacting angle between a distance from one of the contacting surfaces to the other contacting surface and a thickness of the tapered portions.

It is preferred that the fixing member be configured to be fixed in a package including a space for housing the plate-shaped member.

It is preferred that the fixing member be reinforced by a rectangular parallelepiped reinforcing member engaged with outer lateral sides of the fixing member in four directions, in order to be prevented from being deformed outward.

It is preferred that each of the holders and the fixing member be formed of a folded corrugated cardboard assembled in a shape, and that the holders and the fixing member have respective folded portions configured to be developed in a flat shape.

It is preferred that the holder be configured to generate pressing forces to press the paired retainers in directions to bring the paired retainer much closer to each other for holding the plate-shaped member by utilizing a weight of the plate-shaped member to engage the paired supports with the engagement recess of the fixing member, whereby the paired retainers are provided with a holding force.

It is preferred that the holder have a guide member disposed on a rear side of a portion thereof with the retainer of one of the supports disposed therein.

The present invention also attains the object by providing a plate-shaped member holding system comprising a pair of retainers configured to be brought into contact with a front side and a rear side of a plate-shaped member; a pair of holders formed of a compressed paper material in a bar shape, each of the holders being configured to support each of the paired retainers at an intermediate portion thereof in an extending direction, the holders being mounted so as to extend in parallel along a surface of the plate-shaped member; and a pair of couplers configured to generate pressing forces in directions to bring the paired retainer closer to each other and to couple ends of the paired holders projecting outside a peripheral edge of the plate-shaped member in order to clamp the plate-shaped member, each of the couplers being formed of a paper material.

The present invention also provides a plate-shaped member packing device comprising the plate-shaped member holding system defined in any one of Claims 1 to 8, the plate-shaped member holding system being configured to be disposed on at least one side of the plate-shaped member and to be fixed to a box for housing the plate-shaped member.

The present invention also attains the object by providing a method for holding a plate-shaped member, comprising providing a holder and a fixing member, the holder including a pair of retainers for clamping a plate-shaped member from both sides of a front side and a rear side thereof and a pair of supports for supporting the retainers, and holding only a surface portion of the plate-shaped member by the holder; the method further comprising bringing the paired retainers into contact with the front and rear sides of the plate-shaped member, the paired retainer being disposed in the holder; engaging the paired supports of the holder with a engagement recess formed in the fixing member, the supports extending to support the paired retainers; and putting the paired support into the engagement recess in an engaging direction to bias the paired retainers in directions to bring the paired retainers closer to each other so as to clamp the plate-shaped member from both sides of the front and rear sides.

In the present invention, the method for holding a plate-shaped member may comprise fastening the fixing member to a package.

Effects of the Invention

In accordance with the present invention, there is provided a plate-shaped member holding system comprising a holder and a fixing member, the holder including a pair of retainers for clamping a plate-shaped member from both sides of a front side and a rear side thereof and a pair of supports for supporting the retainers; the fixing member comprising an engagement recess engageable with the supports; and the paired support being configured to be pressed in directions to be brought closer to each other in a course of being put into the engagement recess, whereby the paired retainers hold the plate-shaped member from both sides of the front and rear sides. Accordingly, it is possible to stably hold a plate-shaped member by such a relatively simple arrangement. Thus, it is also possible to reduce the weight and the cost of the plate-shaped member holding system since the parts required for the system decreases.

The plate-shaped member holding system according to the present invention can transport a plate-shaped member without damage because of holding the plate-shaped member only at a face portion thereof, having no touch with a peripheral edge thereof. The plate-shaped member holding system according to the present invention can also transport a plate-shaped member, having no touch with parts mounted to the plate-shaped member, such as a molding. Thus, the plate-shaped member holding system according to the present invention can transport a plate-shaped member, as it is, in such a state that the plate-shaped member has a deformable part, such as a molding, mounted to the peripheral edge thereof.

In the plate-shaped member holding system according to the present invention, it is easy to exchange respective parts since the plate-shaped member packing device according to the present invention is formed of plural parts. In this manner, it is possible to exchange the holder with a different one according to the shape of a plate-shaped member to be packed, or to exchange only a deteriorated part with a new one. Thus, it is possible to effectively reuse the respective parts forming the plate-shaped member packing device.

In the plate-shaped member holding system according to the present invention, each of the holders and the fixing member may be formed of a folded corrugated cardboard assembled in a shape, and the holders and the fixing member may have respective folded portions configured to be developed in a flat shape. In such a case, after taking a plate-shaped member out of a box, it is possible to recover the plate-shaped member holding system and deal with the plate-shaped member holding system as a recycle material as in a corrugated cardboard box, and it is possible to reduce the adverse effect to the environment.

In the plate-shaped member holding system according to the present invention, the holder may be configured to generate pressing forces to press the paired retainers in directions to bring the paired retainer much closer to each other for holding the plate-shaped member by utilizing a weight of the plate-shaped member to engage the paired supports with the engagement recess of the fixing member, whereby the paired retainers are provided with a holding force. In such a case, it is possible to hold the plate-shaped member more firmly even if vibration is propagated during transportation. Thus, it is possible to protect the plate-shaped member from wobbling motion during transportation.

EXPLANATION OF REFERENCE NUMERALS

Figure 1:
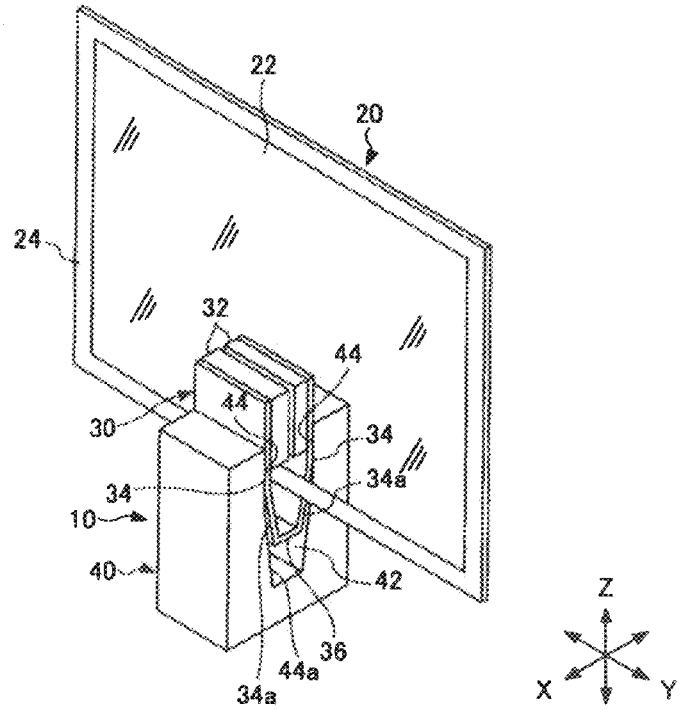
FIG. 1 is a perspective view showing the plate-shaped member holding system according to an embodiment of the present invention.

10, 70, 80, 100, 110 and 150: Plate-shaped member holding system
12, 72, 82, 112, 114, 170 and 190: Plate-shaped member packing device
20: Glass sheet (Plate-shaped member)
22: Glass surface
30: Holder
32: Retainer
34: Support
36: Coupler
40: Fixing member
42: Engagement recess
44: Contacting portion
50: Box (package box)
52: Inner space
54: Fastening member
90: Guide member
102: Bridging portion
120: Reinforcing member
140 and 160: Backboard
144 and 164: Flap
152: Retainer
154: Holder
156: Coupler
180: Enforcing member

BEST MODE FOR CARRYING OUT THE INVENTION

Now, embodiments of the present invention will be described with reference to the accompanying drawings. In the drawings, X, Y and Z directions are indicated by arrows, wherein the X direction is a thickness direction (depth direction) of the plate-shaped member packing device according to the present invention, the Y direction is a transverse direction (left-to-right direction) of the plate-shaped member packing device according to the present invention and the Z direction is a height direction (vertical direction) of the plate-shaped member packing device according to the present invention.

First Embodiment

Figure 2:
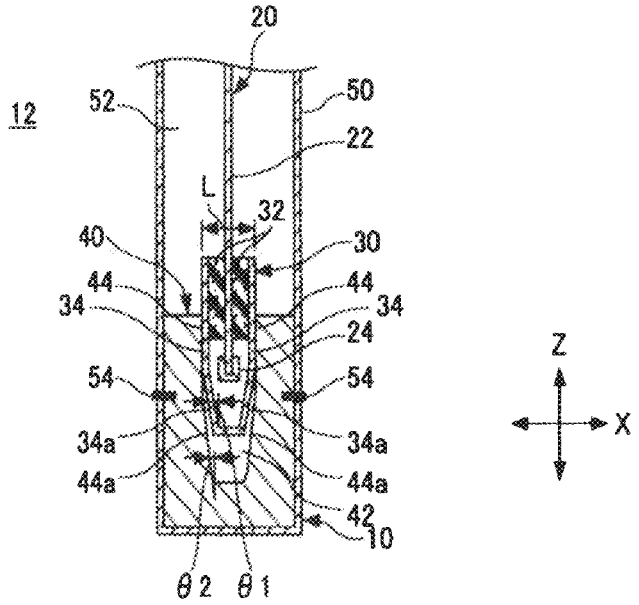
FIG. 2 is a vertical cross-sectional view showing a plate-shaped member packing device using the plate-shaped member holding system shown in FIG. 1.

FIG. 1 is a perspective view showing the plate-shaped member holding system according to an embodiment of the present invention. FIG. 2 is a vertical cross-sectional view showing a plate-shaped member packing device using the plate-shaped member holding system shown in FIG. 1. As shown in FIG. 1 and FIG. 2, the plate-shaped member holding system 10 includes a holder 30 for holding a plate-shaped member, and a fixing member 40 configured to have the holder 30 fitted thereinto. Now, explanation will be made about a case where the plate-shaped member is a glass sheet 20.

The holder 30 includes a pair of retainers 32 for clamping front and rear sides of a glass surface 22 of the glass sheet from both sides, a pair of supports 34 for supporting both retainers 32, and a coupler 36 for coupling the paired supports 34.

Each of the retainers 32 is formed of an elastic material (such as a foamed polystyrene material or rubber) in a parallelepiped shape in order to prevent the glass surface 22 of the glass sheet from being damaged. Each of the retainers 32 has a bonding material (not shown), such as a two-sided adhesive seal, stuck thereon in order to form an antislip film. The antislip film to be stuck is preferably formed of a polyvinylidene chloride (PVDC) material.

The retainers 32 are configured to have a sufficient contact area required for obtaining a holding force for holding the glass sheet 20, although the retainers are smaller than the glass sheet 20. Each of the retainers 32 may have a glass sheet contacting portion formed in a curved shape so as to conform to the shape of a glass sheet 30 to be held.

Each of the paired supports 34 and the coupler 36 is prepared by folding a corrugated cardboard. Each of the supports 34 has a retainer 32 stuck on an inner side at a leading edge thereof. The coupler 36 couples the paired supports 34 at a position outside an outer peripheral edge 24 of the glass sheet 20 so as to be out of contact with the glass sheet 20.

The coupler 36 is configured to have a width in the X-direction set so as to be narrower than the distance L between the paired supports 34 with the retainers 32 stuck thereon. Each of the supports 34 coupled by the coupler 36 has a tapered portion 34*a* formed at a base end thereof therein so as to be inclined at a certain angle θ1 with respect to a corresponding glass surface of the glass sheet 20. It should be noted that each of the tapered portions 34*a* is disposed so as to be out of contact with the outer peripheral edge 24 of the glass sheet 20.

The fixing member 40 is formed of, e.g. a corrugated cardboard and has an engagement recess 42 formed therein so as to receive the supports 34. The engagement recess 42 has contacting portions 44 formed on an inner wall thereof so as to have contact with the supports 34, and each of the contacting portions 44 has a tapered surface 44*a* formed thereon so as to be inclined at a certain angle θ2 with respect to a corresponding glass surface of the glass sheet 20. In the shown embodiment, the above-mentioned inclination angles are set so as to have a relationship of θ1>θ2.

When the paired supports 34 are fitted into the engagement recess 42 of the fixing member 40, the tapered portions 34*a* are brought into contact with the contacting portions 44 formed on the inner wall of the fixing member 40, being engaged between the opposite portions of the inner wall of the engagement recess 42. At that time, the paired retainers 32 are pressed in directions to be brought closer to each other by a relative difference between the distance L between the supports 34 before engagement and the distance L between the supports 34 after engagement, and by a relative contacting angle between each of the contacting portions 44 and each of the paired supports 34. When the holder 30 is pushed downward by the weight of the glass sheet 30, the engagement recess 42 presses the paired supports 34 inwardly to firmly bias the paired retainers 32 in directions to be brought closer to each other since the engagement recess 42 is configured to have the tapered surfaces 44*a* inclined so as to gradually decrease the distance between the contacting portions 44 (a width thereof) in a downward direction. The paired retainers 32 firmly clamp the glass surface 22 of the glass sheet 30, utilizing the biasing force.

Although explanation has been made about a case where the engagement recess 42 has the contacting portions 44*a*, the supports 34 have the tapered portions 34*a*, and the engagement recess 42 and the supports 34 are configured to be combined so as to have the certain angles θ1 and θ2, such an inclination may be disposed in only the engagement recess 42 or only the paired supports 34.

When the engagement recess 42 or the paired supports 34 have an inclination at a certain angle in the Z-direction, it is possible to smoothly perform the engagement. Since the holder 30 is pushed downward by the weight of the glass sheet 30, it is possible to apply a pressing force to the glass sheet 20.

Even if a downward shift is applied to the holder 30 by, e.g. vibration during transportation, the supports 34 can shift downward, keeping contact with the contacting portions 44 of the engagement recess 42, to absorb a shock since the engagement recess 42 of the fixing member 40 has a bottom formed so as to be sufficiently away from the coupler 36 of the holder 30. At that time as well, the paired supports 34 are firmly pressed inwardly because of shifting downward. By this arrangement, even if the supports 34 shift slightly downward, it is possible to maintain a sufficient holding force for the glass sheet 20. When the plate-shaped member holding system 10 is fitted to a lower portion of the glass sheet 20 even in a stage prior to housing the glass sheet 20 into a box (package box) 50, it is possible to support the glass sheet 20 in an upright position, utilizing the plate-shaped member holding system 10 as a support, since the plate-shaped member holding system is configured so that the supports 34 applies a stable holding force by engagement with the engagement recess 42.

In the plate-shaped member packing device 12 according to the present invention using the plate-shaped member holding system 10, the fixing member 40 is put into an inner space 52 in a box as the box 50 for housing the glass sheet 20 and is fixed to the box 50 forming the box by fastening members (such as staples) 54 in such a state that the fixing member 40 sets down on the bottom of the box 50 as shown in FIG. 2. Thus, the glass sheet 20 is fixed to the box 50, being out of contact with the box 50, in such a state that the glass sheet is held from both sides by the retainers 32.

When each of the box 50, the holder 30 and the fixing member 40 is formed of a corrugated cardboard, it is possible that the box, the holder and the fixing member are deteriorated by temperatures or humidity due to a long period of store in, e.g. a storehouse after delivery. However, even if the supports 34 shift downward, having contact with the contacting portions 44 of the engagement recess 42, due to a decrease in the strength of the holding system caused by deterioration, it is possible to maintain the holding force of the paired supports 34 at a sufficient level since the supports 34 are brought into contact with the tapered surfaces 44*a* in the course of shifting downward. Thus, it is possible to stably store the glass sheet 20 for a long period of time by the plate-shaped member holding system 10.

The plate-shaped member holding system 10 configured as described above holds the glass sheet 20 only on the glass surface 22 (surface portion) and has no contact with the outer peripheral edge 24. By using the plate-shaped member holding system 10, it is possible not only to transport the glass sheet 20 without damage but also to transport the glass sheet 20 without contact with parts mounted to the glass sheet 20. By the plate-shaped member holding system 10, it is possible to transport the glass sheet 20 without dismounting deformable parts mounted to the outer peripheral edge 24 of the glass sheet, such as a molding.

It is easy to exchange parts with different ones in the plate-shaped member holding system 10 since the plate-shaped member packing device 12 is formed of plural parts. For example, it is possible to effectively reuse the plate-shaped member holding system since the holder 30 can be exchanged with a different one according to the shape of a glass sheet 20 to be packed or only a deteriorated part can be exchanged with a new one.

Figure 3:
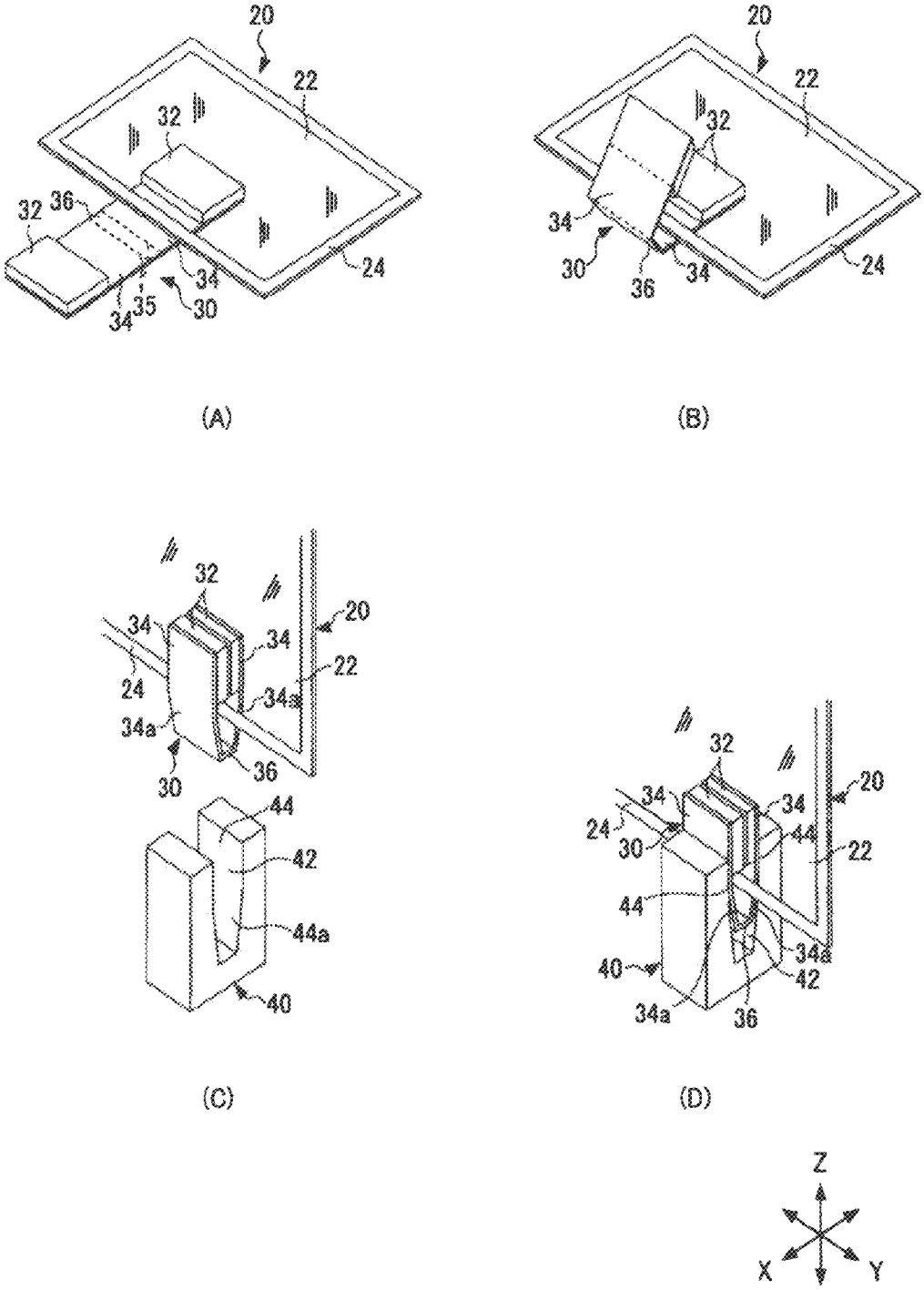
FIG. 3 contains views showing steps of mounting a holder to a glass sheet and fitting the holder into an engagement recess.

Now, the steps of a method for holding a plate-shaped member by use of the plate-shaped member holding system 10 configured as described above will be explained in reference to FIGS. 3(A) to (D). First, in step 1, one of the retainers 32 is brought into contact with a lower side (rear side) of the glass sheet 20 with the holder 30 being unfolded as shown in FIG. 3(A). At that time, the other retainer 32 and the coupler 36 are positioned outside the outer peripheral edge 24 of the glass sheet 20.

The holder 30, which is formed of a corrugated cardboard, has creases 35 (indicated by dotted lines in FIG. 3(A)) pressed thereon between the coupler 36 and each of the supports 34. By folding the holder along the creases 35, the other retainer 32 is moved to be brought into contact with an upper side (front side) of the glass surface 22 of the glass sheet 20 in Step 2 as shown in FIG. 3(B). In this state, the other retainer 32 is floating above the glass surface 22 of the glass sheet 20 since no holding force is applied to the paired supports 34.

The glass sheet 20 is set in an upright position so that the holder 30 is positioned at a lower side of the glass sheet 20 in Step 3 as shown in FIG. 3(C). The fixing member 40 having the engagement recess 42 is put on a floor under the holder 30. It should be noted that the retainers 32 are temporarily fixed to be prevented from falling out by being simply pressed against the glass surface 22 of the glass sheet 20.

The supports 34 of the holder 30, which has been temporarily fixed to the lower side of the glass sheet 20, is fitted into the engagement recess 42 of the fixing member 40 in Step 4 as shown in FIG. 3(D). At that time, the supports 34 are subjected to inward pressing forces since the tapered portion 34*a* are brought into contact with the contacting portions 44 of the engagement recess 42. In this manner, the paired retainers 32, which are disposed on the inner sides at the leading edges of the supports 34, clamp the front side and the rear side of the glass surface 22 of the glass sheet 20. Thus, the glass sheet 20 is subjected to forces in directions for the paired retainers 32 to be brought closer to each other by the holder 30 engaged with the engagement recess 42 of the fixing member 40 as shown in FIG. 1. Accordingly, the glass sheet 20 is held, being pressed from both sides of the glass surface 22.

After the plate-shaped member holding system 10 with the glass sheet held therein is put into the inner space 52 of the box 50, having the lower side of the glass sheet 20 held by the holder 30 and the fixing member 40 as shown in FIG. 2, the box 50 is fastened and fixed to the fixing member 40. As explained above, it is possible not only to transport a plate-shaped member without damage but also to transport the plate-shaped member without deforming the parts mounted to the plate-shaped member since the plate-shaped member holding system 10 holds only the surface portion of the plate-shaped member without having contact with the peripheral edge of the plate-shaped member.

In accordance with the plate-shaped member holding system 10, it is possible to assemble the glass sheet 20 to the plate-shaped member holding system so as to hold the glass sheet 20 in an upright position by a relatively simple operation as described above. It is also possible to effectively and stably house the glass sheet 20 in the inner space 52 of the box 50 without trouble.

Since each of the holder 30 and the fixing member 40 of the plate-shaped member holding system 10 is formed of a paper material, such as a corrugated cardboard, it is possible for a recycle service to recover the plate-shaped member holding system along with an box 50 for easy reuse as recycle materials after taking a glass sheet out of the box 50. The non-slip films (not shown) are stuck on the retainers 32 so as to be easily peelable when the films are not pressed against something. Thus, it is easy to sort the respective materials, improving recyclability.

It is easy to exchange parts with different ones in the plate-shaped member holding system 10 since the plate-shaped member packing device is formed of plural parts. It is possible to exchange the holder with a different one according to the shape of a plate-shaped member to be packed or to exchange only a deteriorated part with a new one. Accordingly, it is possible to effectively reuse the respective parts forming the plate-shaped member holding system.

Figure 4:
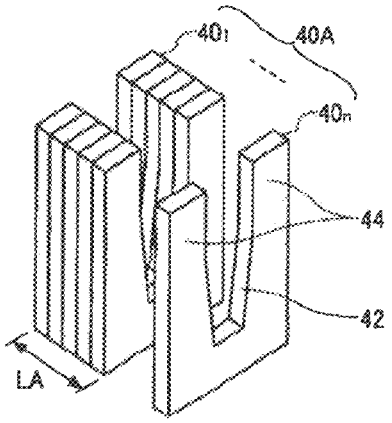
FIG. 4 contains perspective views showing first and second examples of a fixing member.
Figure 4:
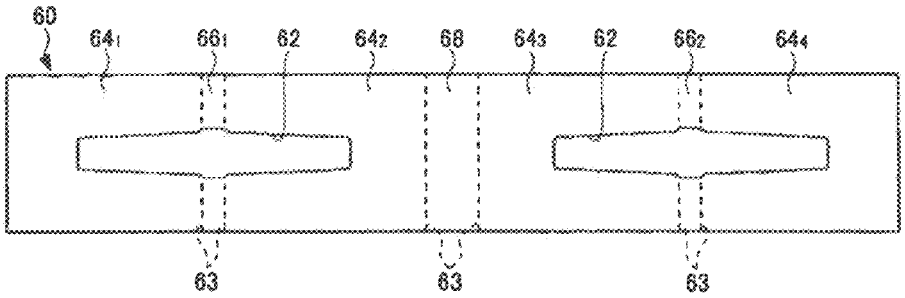
Figure 4:
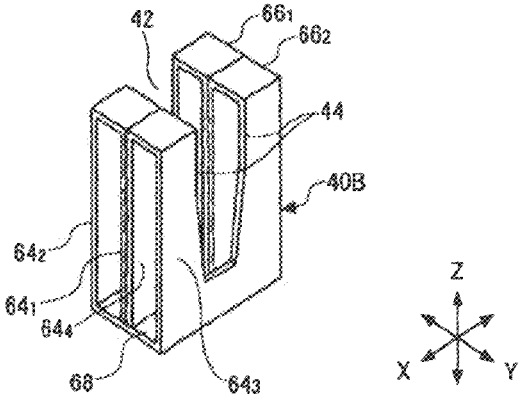

FIGS. 4(A) to (C) are perspective views showing a first example of the fixing member 40. As shown in FIG. 4(A), the fixing member 40A according to the first example is prepared by bonding and stacking plural corrugated cardboards $\mathbf{40}_1$ to $\mathbf{40}_n$. Each of the corrugated cardboards $\mathbf{40}_1$ to $\mathbf{40}_n$ is punched out so as to form an engagement recess 42 and contacting portions 44 as described above. The number of the stacked corrugated cardboards $\mathbf{40}_1$ to $\mathbf{40}_n$ may be selectively determined according to the weight of a glass sheet 20. Thus, it is possible to increase the number of the corrugated cardboards forming the fixing member 40A as the weight of a glass sheet 20 increases. It is possible to configure the fixing member 40A so as to have a depth size $L_A$ set at a value corresponding to any kinds of glass sheets 20.

FIG. 4(B) is a developed view showing a second example of the fixing member 40, and FIG. 4(C) is a perspective view showing how the second example of the fixing member 40 is assembled. When the fixing member 40B according to the second example is developed, it is seen from FIG. 4(B) that the fixing member is formed of an elongated corrugated cardboard 60. The corrugated cardboard 60 may be cut out of a single large corrugated cardboard, the corrugated cardboard 60 has openings 62 punched out therein so as to have tapered portions, and the corrugated cardboard has creases formed thereon (as indicated by dotted lines in FIG. 4(B)). In the corrugated cardboard 60, wall portions $\mathbf{64}_1$ to $\mathbf{64}_4$, upper portions $\mathbf{66}_1$ and $\mathbf{66}_2$, and a bottom portion 68 are continuously formed, being bounded by the creases 63.

When the developed corrugated cardboard 60 is folded along the creases 63, the fixing member 40B is assembled with the four wall portions $\mathbf{64}_1$ to $\mathbf{64}_4$ upright between the upper portions $\mathbf{66}_1$ and $\mathbf{66}_2$ and the bottom portion 63 as shown in FIG. 4(C). The wall portions $\mathbf{64}_1$ to $\mathbf{64}_4$ are assembled to form an engagement recess 42 by the openings 62.

As described, the fixing member 40B can be easily assembled by folding the single corrugated cardboard 60. When the fixing member is unfolded as a developed corrugated cardboard 60 as shown in FIG. 4(B) after taking out a glass sheet 20 out of an box 50, it is possible to recover the fixing member for recycling.

Although explanation has been made about a case where the retainers 32 hold a glass sheet at a substantially central portion of the holder 30, the opposing retainers 32 may have different thickness according to the shape of a plate-shaped member to be held.

This modification is suitably applicable to hold a curved glass sheet or a glass sheet with, e.g. dissymmetrical moldings mounted to front and rear sides thereof.

Although explanation has been made about a case where the holder 30 includes the coupler 36 outside the outer peripheral edge 24 of the glass sheet 20, the paired supports 34 may be uncoupled. When the paired supports of the holder 30 are coupled by the coupler 36, it is possible to improve workability and to decrease the number of required parts. When the holder 30 are configured without the supports being coupled, it is increase design freedom for the holder and to economically exchange only one of the paired members.

The corrugated cardboard means one with a liner board bonded to a single side or both sides of a corrugating medium. Although the corrugated cardboard is mainly formed of paper, the corrugated cardboard may be formed of another material as in a polypropylene corrugated cardboard (so-called PP corrugated cardboard). The following embodiments can also have the same advantages as the above-mentioned advantages unless they depart from the scope of the present invention.

After the holder is engaged with a larger holder or larger holders before being engaged with the fixing member, the holders may be engaged with the fixing member. By this arrangement, it is possible to increase the force for pressing a plate-shaped member and to deal with a heavy plate-shaped member. Although the holder may have four layers or more stacked therein, it is preferred in terms of easy handling that the holder have two or three layers stacked therein.

Second Embodiment

Figure 5:
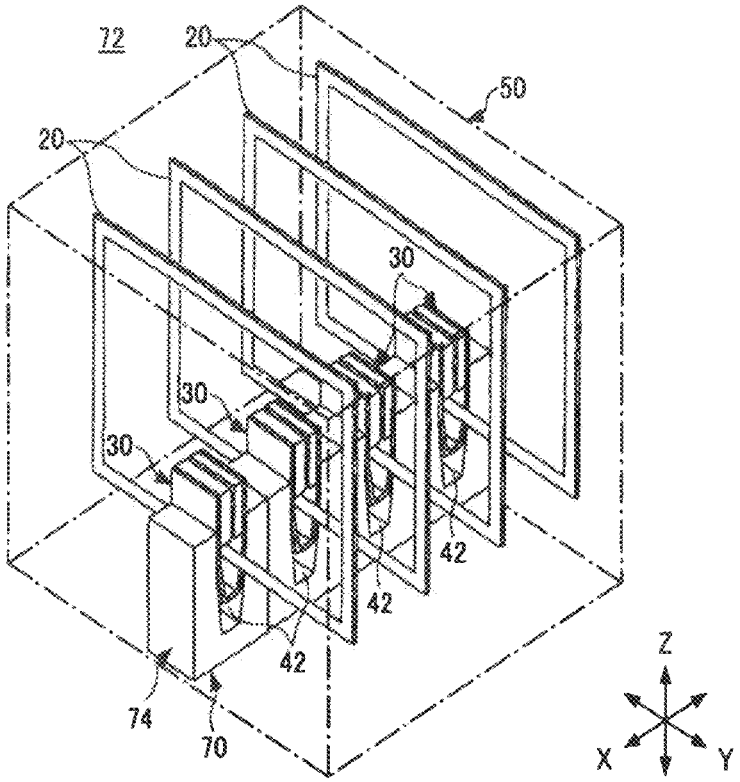
FIG. 5 is a perspective view showing the plate-shaped member holding system and the plate-shaped member packing device according to a second embodiment of the present invention.

FIG. 5 is a perspective view showing the plate-shaped member holding system 70 and the plate-shaped member packing device 72 according to a second embodiment. In FIG. 5, parts similar or identical to the parts according to the first embodiment are indicated by the same reference numerals, and explanation of those parts will be omitted.

As shown in FIG. 5, the plate-shaped member holding system 70 according to the second embodiment includes a fixing member 74, which has plural engagement recesses 42 formed at intervals. The fixing member 74 is prepared by stacking corrugated cardboards or folding corrugated cardboards as in the fixing member 40 according to the first embodiment. The fixing member 74 is housed in and fastened to an box 50 (indicated by dashed dotted lines in FIG. 5), which is enough to house plural glass sheets 20.

When plural glass sheets 20 are put into the box 50, the glass sheets 20 with holders 30 temporarily fixed thereto are put from above, one by one, into the box 50 with an upper portion thereof opened, and the temporarily fixed holders 30 are fitted into the engagement recesses 42. Thus, the plural glass sheets 20 are held, being disposed with certain intervals in the box 50, and the holders 30 are fixed to the fixing member in such a state that the supports 34 of the holders are brought into contact with the contacting portions 44 of the engagement recesses 42.

Even when the plural glass sheets 20 are housed into a single box 50, the plate-shaped member packing device 72 using the plate-shaped member holding system 70 function effectively as described above. In this manner, it is possible to pack the plural glass sheets 20 efficiently.

Although explanation of FIG. 5 has been made about a case where the engagement recesses 42 are disposed at four positions in the fixing member 74 to pack the four glass sheets 20, the plate-shaped member packing device may be configured so as to house four or more of glass sheets 20 in the box 50 according to the sizes of the glass sheets.

Third Embodiment

Figure 6:
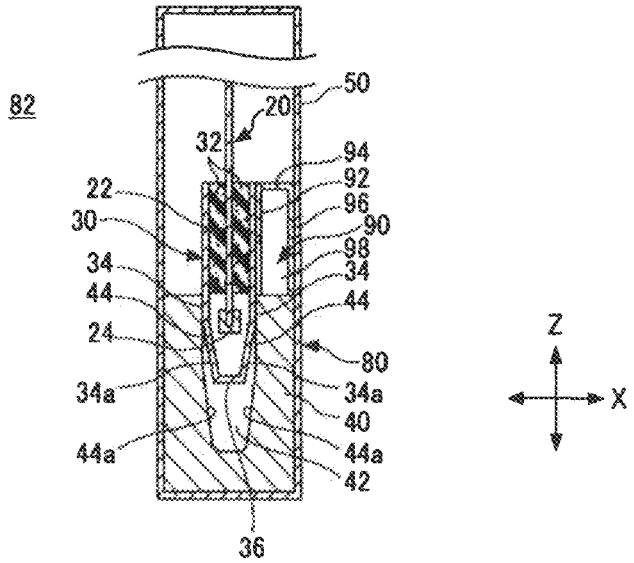
FIG. 6 is a vertical cross-sectional view showing the plate-shaped member holding system and the plate-shaped member packing device according to a third embodiment of the present invention.

FIG. 6 is a vertical cross-sectional view showing the plate-shaped member holding system 80 and the plate-shaped member packing device 82 according to a third embodiment. In FIG. 6, parts similar or identical to the parts according to the above-mentioned embodiments are indicated by the same reference numerals, and explanation of the those parts will be omitted.

As shown in FIG. 6, the plate-shaped member holding system 80 according to the third embodiment is configured so as to combine a guide member 90 with the holder 30. The guide member 90 is interposed between a support 34 and the box 50 to guide the holder 30 so as to place the position of the holder in alignment with the engagement recess 42 of the fixing member 40. Although the guide member 90 is normally disposed only between the box 50 and one of the paired support 34 forming the holder 30, the guide member may be disposed between the box 50 and each of the supports 34.

In the plate-shaped member packing device 82 according to the third embodiment, a glass sheet 20 with the holder 30 temporarily fixed thereto is put into the box after the fixing member 40 is disposed on the bottom in the box 50. After that time, the guide member 90 is slid along an inner wall of the box 50, placing the coupler 36 of the holder 30 in alignment with the engagement recess 42. In this manner, it is possible to put the glass sheet 20 into the box 50 without damaging the glass surface 22 even if the packing operation is extremely difficult as in a case where the glass sheet has a relatively large area and is heavy.

In the plate-shaped member packing device 82 using the plate-shaped member holding system 80 with the above-mentioned guide member 90, even if vibration is applied in a horizontal direction in a case where the glass sheet 20 is transported in an upright position, the guide member 90 can prevent the holder 30 from being swayed in the horizontal direction. Even if vibration directed to the horizontal direction is propagated to the box 50, e.g. when the freight truck is running on an unpaved road, it is possible to hold the glass sheet 20 without the vibration in its glass surface 22 being amplified, since the holder 30 is supported by the guide member 90 to prevent the glass sheet from being significantly swayed about the holder 30.

Now, a method (procedure) for mounting the guide member 90 will be described in reference to FIGS. 7(A) to (D). First, the holder 30 and the guide member 90 are prepared, being developed, as shown in FIGS. 7(A) to (D). The guide member includes a fixing portion 92 to be fixed to the rear side of a support 34, a stopper 94 to ensure a certain gap between the support and the inner wall of the box 50, a contacting surface 96 to be brought into contact with the inner wall of the box 50, and engageable portions 98 to be engaged with engagement apertures 92*a* formed in the fixing portion 92 after being bent at right angles from both sides of the contacting surface 96. The guide member 90 is formed of a corrugated cardboard and has creases 99 (indicated in dotted lines in FIG. 7(A)) pressed at the boundary between adjacent parts thereon.

Figure 7:
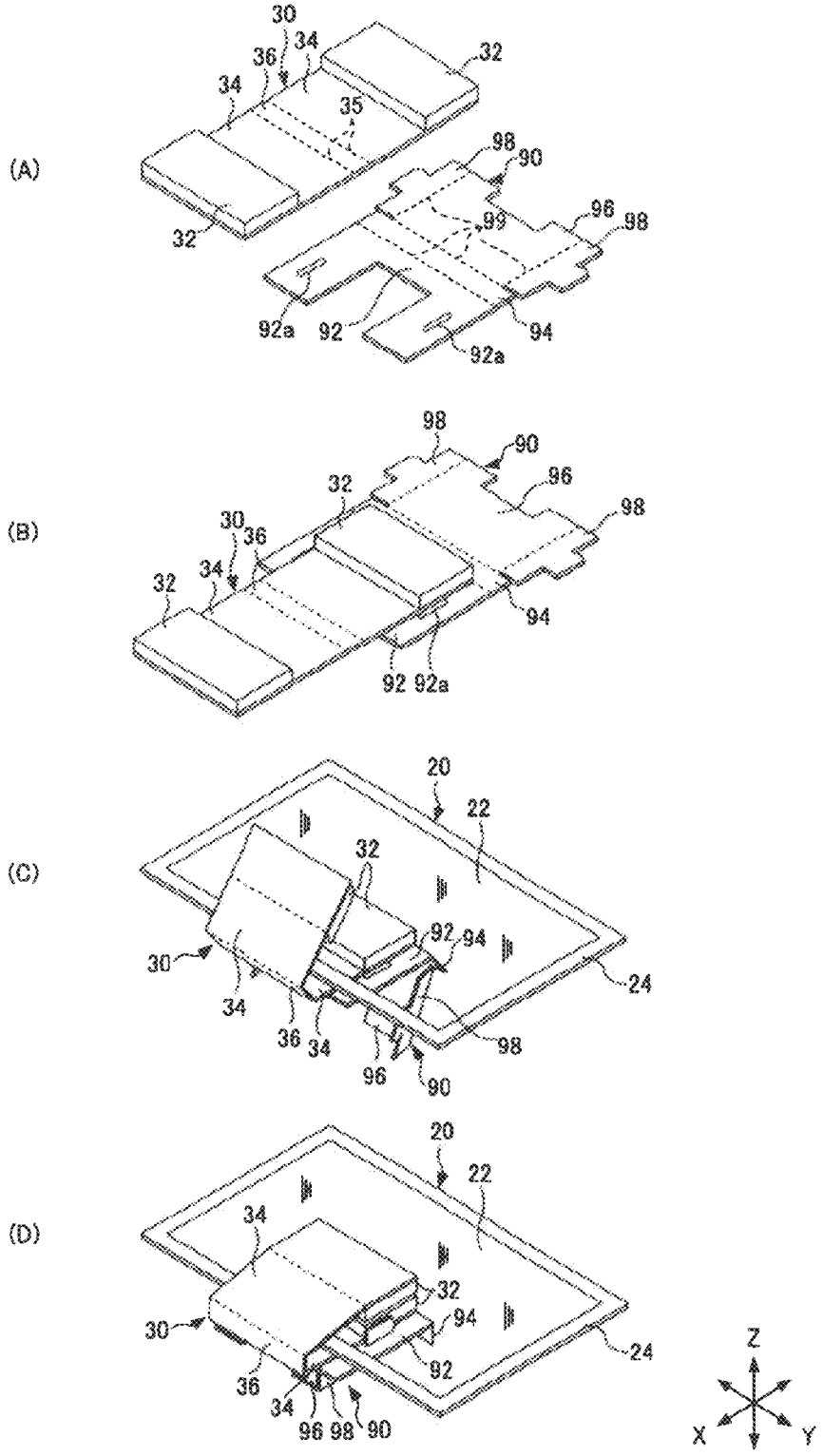
FIG. 7 contains perspective views showing steps of mounting a guide member to a holder and mounting the guide member and the holder to a glass sheet.

In the next step, the rear side of the support 34 is fixed to the fixing portion 92 of the guide member 90 through a fixing material, such as an adhesive or a two-sides adhesive seal, as shown in FIG. 7(B). At that time, the support 34 is disposed at a position between the paired engagement apertures 92*a* and 92*a*, each of which is formed in the fixing portion 92 so as to extend in parallel in an elongated shape. It should be noted that the distance between the paired engagement apertures 92*a* and 92*a* is set to be slightly wider than the width of the support 34. When the paired engagement portions 98 are combined with the fixing portion 92 so as to have fitted portions inserted into the paired engagement apertures 92*a*, the fitted portions have leading edges brought into contact with both sides of the support 34 (see FIG. 7(D)).

In the next step, the retainer 32 of the support is temporarily fixed to the rear side of the glass surface of the glass sheet 20, and the stopper 94 and the contacting surfaces 96 of the guide member 90 are folded outside along the creases 99 as shown in FIG. 7(C).

In the next step, the paired engagement portions 98 are folded inward and are engaged with the paired engagement apertures 92*a* of the fixing portion 92 as shown in FIG. 7(D). Thus, the stopper 94 and the engagement portions 98 are folded at right angles with respect to the support 34 and the box 50. The contacting surface 96 of the guide member 90 is supported so as to be brought into contact with the inner wall of the box 50 by the stopper 94 and the engagement portions 98.

Figure 8:
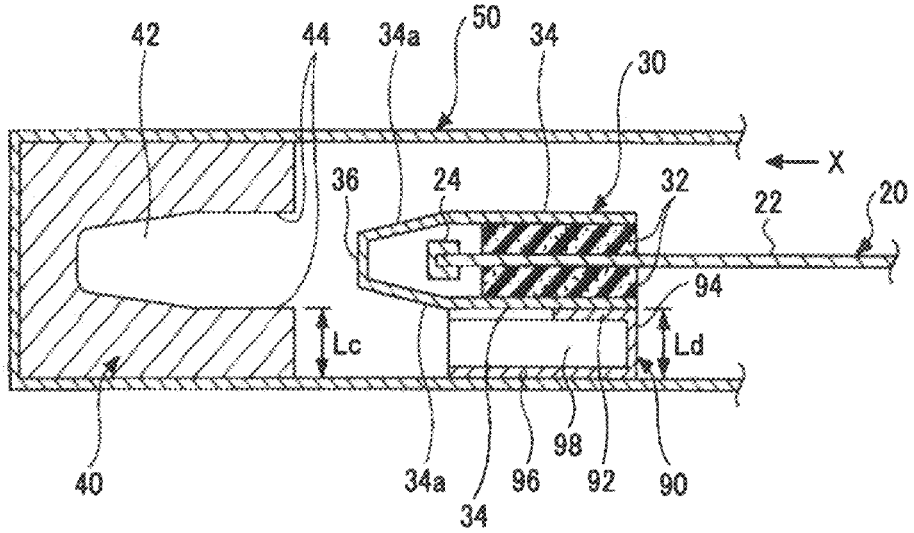
FIG. 8 is a vertical cross-sectional view showing a step of putting a glass sheet into a box by utilizing the guide member.

In the next step, the glass sheet 20 is put into the box 50 through the opening of the box in such a state that the box 50 with the fixing member 40 fixed to the bottom thereof is put in a horizontal position as shown in FIG. 8. At that time, the glass sheet 20 is put into the box from a side thereof with the holder 30 and the guide member 90 mounted thereto. It should be noted that the contacting surface 96 of the guide member 90 is configured so that the distance between the fixing portion 92 and the contacting surface corresponds to the position of the engagement recess 42 of the fixing member 40 by the provision of the stopper 94 and the engagement portions 98.

When the glass sheet 20 is put into the box 50 in the X-direction (see FIG. 8) with the contacting surface 96 of the guide member 90 sliding on the inner wall of the box, the height Lc of the holder 30 accords with the height Ld of the engagement recess 42 (Lc=Ld). By this arrangement, even if the glass sheet 20 has a large area and is heavy, it is possible to relatively easily put the glass sheet 20 into the box in order to engage the holder 30 with the engagement recess 42 with the glass sheet being supported in a horizontal position by the guide member 90.

Thus, it is possible to pack the glass sheet 20 more effectively by mounting the guide member 90 to the holder 30. When the glass sheet 20 is transported, being housed in the box 50, the guide member 90 suppresses the swaying movement of the glass sheet 20, preventing the glass sheet 20 from being damaged by vibration.

Figure 9:
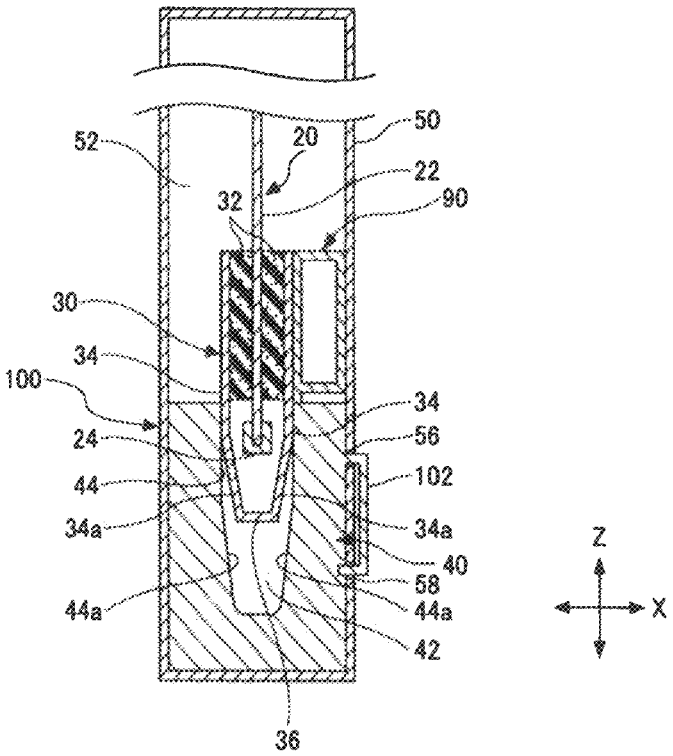
FIG. 9 is a vertical cross-sectional view showing a modified embodiment of the third embodiment.

Since the guide member 90 is formed by folding a corrugated cardboard, it is possible to easily reuse the guide member along with the holder 30 and the fixing member 40 as recycle materials by unfolding the guide member after use. It should be noted that the guide member 90 may be formed integral with the holder 30, using a single corrugated cardboard. FIG. 9 is a vertical cross-sectional view showing a modification of the third embodiment. In FIG. 9, parts similar or identical to the parts according to the third embodiment are indicated by the same reference numerals, and explanation of those parts will be omitted. As shown in FIG. 9, the plate-shaped member holding system 100 according to the modification of the third embodiment is configured so that a bridging portion 102 is shaped out of the wall portion of the fixing member 40, and the bridging portion passes through through holes 56 and 58 formed in the box 50, followed by being bent in a U-character shape. Thus, the fixing member 40 is fixed to the box 50. In this manner, a glass sheet 20 held by the plate-shaped member holding system can be fixed in any direction containing a front-to-rear direction, a vertical direction and a left-to-right direction. Thus, it is possible to stably hold the glass sheet 20 in the inner space 52 of the box 50 even if vibration or a shock is propagated during transportation.

Fourth Embodiment

Figure 10:
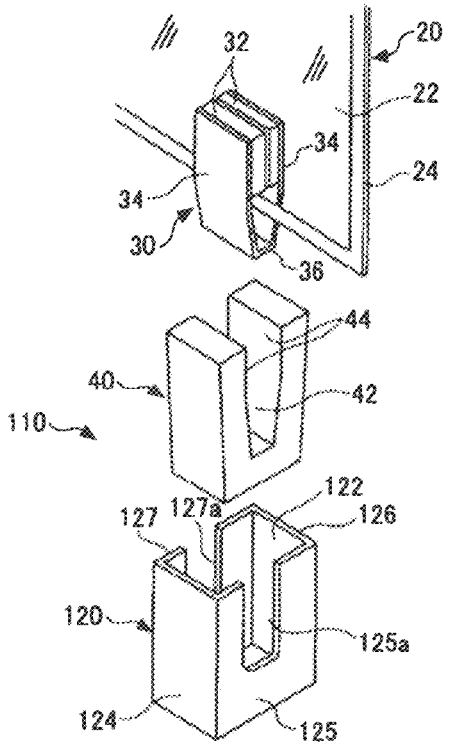
FIG. 10 contains perspective views showing the plate-shaped member holding system according to a fourth embodiment of the present invention.
Figure 10:
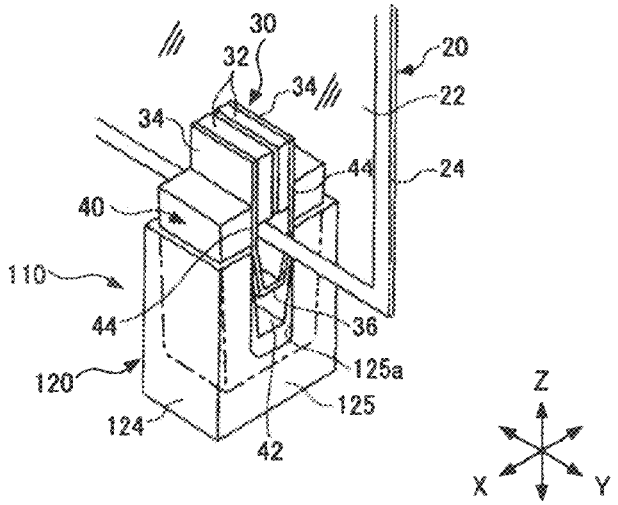
Figure 11:
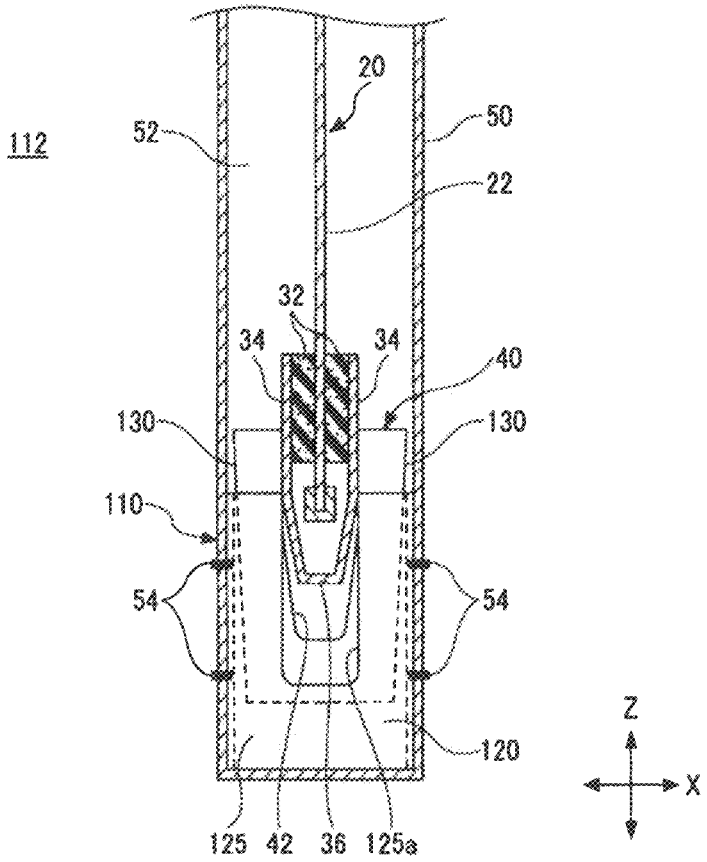
FIG. 11 is a vertical cross-sectional view showing a plate-shaped member packing device using the plate-shaped member holding system according to the fourth embodiment.

FIG. 10(A) is an exploded perspective view showing the plate-shaped member holding system 110 according to a fourth embodiment. FIG. 10(B) is a perspective view showing how the plate-shaped member holding system 110 according to the fourth embodiment is assembled. FIG. 11 is a vertical cross-sectional view showing how the plate-shaped member holding system 110 according to the fourth embodiment is assembled. It should be noted that in FIGS. 10(A) and (B) and FIG. 11, parts similar or identical to the parts according to the above-mentioned embodiments are indicated by the same reference numerals, and explanation of those parts will be omitted.

As shown in FIG. 10(A), the plate-shaped member holding system 110 according to the fourth embodiment is configured to have the holder 30 and the fixing member 40 combined with a reinforcing member 120. The reinforcing member 120 is formed in a rectangular parallelepiped frame and is formed of a material having a high mechanical strength, which is prepared by compressing a corrugated cardboard or a paper material to increase the strength. The reinforcing member 120 is configured to include a space 122 for receiving the fixing member 40 and walls 124 to 127, which are upright to form such a rectangular parallelepiped frame so as to surround the four directions of the space 122. Walls 125 and 127 of the walls 124 to 127, which confront the engagement recess 42 of the fixing member 40, have notches 125*a* and 127*a* formed in a U-character shape therein so as to receive a glass sheet 20.

When the fixing member 40 is put into the space 122 through an upper opening of the reinforcing member 120, the reinforcing member is engaged with the lateral sides of the fixing member 40 in the four directions, reinforcing the fixing member 40 so as to prevent the fixing member from being spread even if the engagement recesses 42 of the fixing member receives the weight of the glass sheet 20. In this embodiment, as shown in FIG. 10(B) and FIG. 11, the reinforcing member 120 is put on the bottom of the box 50, having the fixing member 40 put in the space 122, and the holder 30 is engaged with the engagement recess 42, being temporarily fixed to a lower portion of the glass sheet 20.

Thus, the reinforcing member 120 suppresses the deformation of the fixing member 40 outward. As a result, the reaction force against the holder 30 from the contacting portions 44 of the engagement recess 42 is increased. In this manner, the plate-shaped member holding system 110 more firmly presses the retainers 32 against the glass surface 22 of the glass sheet 20 as the supports 34 of the holder 30 are fitted into the engagement recess 42. Thus, the pressing force of the holder 30 is increased, further firmly holding the glass sheet 20 in comparison with the above-mentioned embodiments.

The fixing member 40 according to this embodiment has tapered surfaces 130 formed on lateral sides thereof in contact with the walls 124 and 126 of the reinforcing member 120. The tapered surfaces 130 are inclined so as to have a wider width toward the top and a narrower width toward the bottom as shown in the dotted lines in FIG. 10(B). When the load of the glass sheet 20 is applied in the Z-direction, not only a holding force generated between the holder 30 and the engagement recess 42 of the fixing member 40 is applied to the retainers 32, but also a holding force generated between each of the tapered surfaces 130 of the fixing member 40 and each of the walls 124 and 126 of the reinforcing member 120 is applied to the retainers 32, increasing the total holding force for the glass sheet 20.

By combining the holder 30, the fixing member 40 and the reinforcing member 120 in the plate-shaped member holding system 110 as described above, it is possible to more firmly hold the glass sheet 20. In the plate-shaped member packing device 112 according to the fourth embodiment, the walls 124 and 126 of the reinforcing member 120, and the box 50 are fastened together by fastening members 54, being unified. Thus, the glass sheet 20, which has been housed in the inner space 52 of the box 50, can be stably fixed to the box 50.

Since the reinforcing member 120 is formed of a rectangular parallelepiped frame made of a material having a high mechanical strength prepared by compressing a corrugated cardboard or a paper material to increase the strength in this embodiment, it is possible to reuse the reinforcing member along with the holder 30 and the fixing member 40 as recycle materials by developing the reinforcing member after use.

Figure 12:
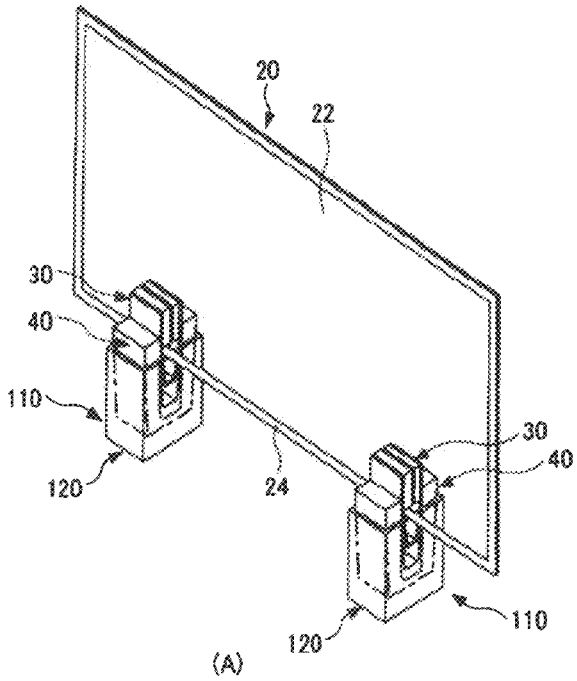
FIG. 12 contains perspective views showing a modified embodiment of the fourth embodiment.
Figure 12:
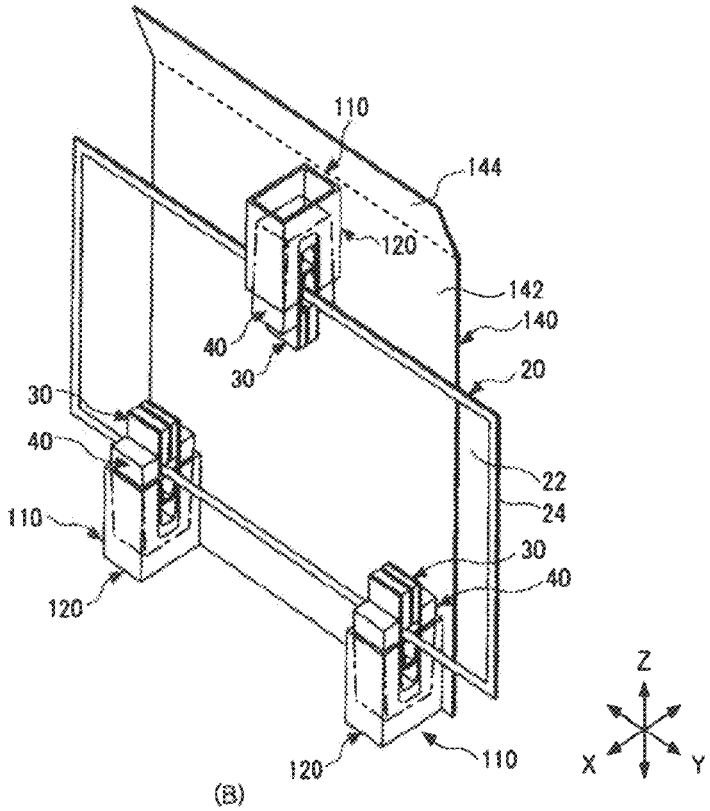

FIG. 12(A) is a perspective view showing a case where plural plate-shaped member holding systems 110 are used. If the glass sheet 20 has a relatively long side, it is possible to stably hold the glass sheet 20, even if the glass sheet is heavy, by disposing the plate-shaped member holding systems 110, e.g. two plate-shaped member holding systems, on a lower portion of the glass sheet as shown in FIG. 12(A).

FIG. 12(B) is a perspective view showing a modification of the fourth embodiment. If the glass sheet 20 has a relatively great height, the plate-shaped member holding systems 110 are disposed at plural locations of an upper portion and the lower portion of the glass sheet 20 as shown in FIG. 12(B). The plural plate-shaped member holding systems 110 are coupled on a backboard 140 (formed of a corrugated cardboard), which is upright on the rear side of the glass sheet 20. In this modification, the reinforcing members 120 of the respective plate-shaped member holding systems 110 are mutually coupled together by being fastened to the backboard 140.

Figure 13:
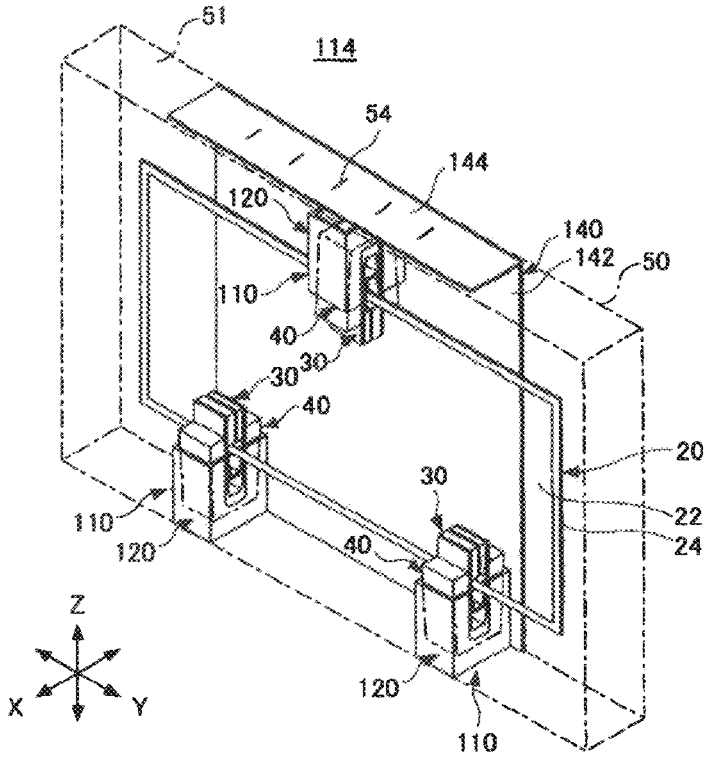
FIG. 13 contains views showing a plate-shaped member packing device using the modified embodiment of the fourth embodiment.
Figure 13:
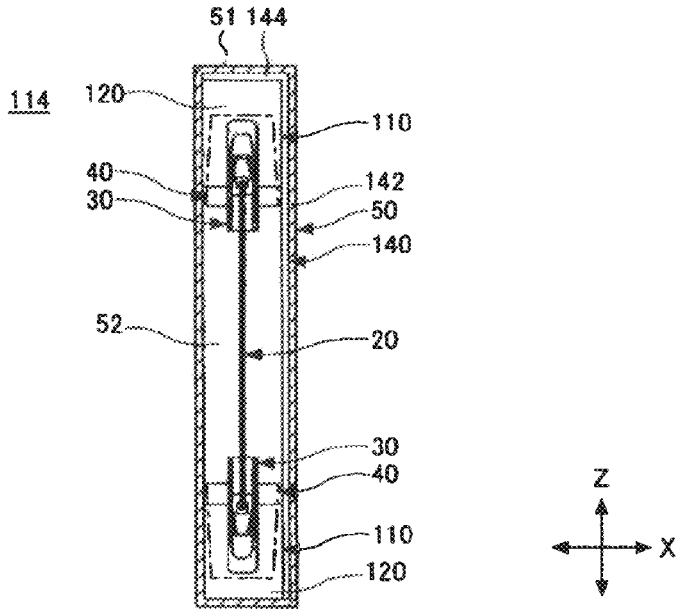

FIG. 13(A) is a perspective view of a plate-shaped member packing device 114 using the modification of the fourth embodiment. FIG. 13(B) is a vertical cross-sectional view of the plate-shaped member packing device 114 using the modification of the fourth embodiment. As shown in FIG. 13(A) and FIG. 13(B), the plate-shaped member packing device 114 using the backboard 140 and the plate-shaped member holding systems 110 is configured so that the backboard 140 is put into the inner space 52 of a box 50 to prevent the relative positions of the respective plate-shaped member holding systems 110 from shifting.

The backboard 140 includes a supporting surface 142 for fastening the respective plate-shaped member holding systems 110 thereto, and a flap 144, which is formed by folding an upper portion of the supporting surface 142 in a horizontal direction. When the glass sheet 20 is housed and packed in the inner space 52 of the box 50, the glass sheet 20 is held by the plural plate-shaped member holding systems 110. Thus, the glass sheet 20, which has been held by the plural plate-shaped member holding systems 110, can be put into the box 50 (indicated in dashed dotted lines in FIG. 13(A)) through the upper opening of the box, as it is, by holding the flap 144. By this arrangement, it is possible to more easily pack the glass sheet 20 by using the backboard 140 even if the glass sheet is large. The flat 144 is folded at an angle of 90 degrees to close the opening of the box 50, a lid 51 of the box is overlapped with the flap 144, and the flap 144 and the lid 51 are fastened together by fasteners 54, such as staples.

By fastening the flap 144 of the backboard 140 to the box 50 as described above, the plural plate-shaped member holding systems 110 for holding the glass sheet 20 is stably supported without wobbling. Thus, it is possible to reliably hold the glass sheet 20 since the plural plate-shaped member holding systems 110 are prevented from shifting even if vibration or a shock is applied during transportation.

The glass sheet 20 housed in the box 50 is held at three positions in the upper and lower portions thereof by the plate-shaped member holding systems 110, and the reinforcing members 120 of the respective plate-shaped member holding systems 110 are put into the box 50, being brought into contact with the inner wall of the box 50. Thus, the glass sheet is firmly held so as to be prevented from wobbling even if vibration is applied in any direction of the front-to-rear direction, the left-to-right direction and the vertical direction (the X direction, the Y direction and Z direction).

When the glass sheet is taken out after delivery, it is possible to take out the glass sheet by holding the flap 144 and drawing the backboard 140 along with the glass sheet out of the box 50. At that time, the glass sheet 20 is taken out, being held by the plural plate-shaped member holding systems 110 fastened to the backboard 140. Thus, it is possible to easily take out the glass sheet 20 by using the backboard 140 to couple the plural plate-shaped member holding systems 110. The backboard 140 may be formed of a folded corrugated cardboard. The backboard may be formed in any shape other than the above-mentioned shape. It is possible to easily reuse the backboard along with the box 50 as recycling materials after use.

Although explanation has been made about a case where the plate-shaped member holding systems 110 are fixed to the backboard 140, the plate-shaped member holding systems 110 may be fixed directly to the box without using the backboard. The backboard 140 and the flap 114 may be formed as separated members. The backboard 140 may be formed without having the flap 114. The fixing of the plate-shaped member holding systems 110 to the backboard and the fastening of the flap 114 of the backboard to the box may be made at plural locations by use of fastening members 54 as required. Each of the fastening members 54 may be formed of an adhesive tape, an adhesive, such as a hot melt, or any one of the other fastening materials.

Fifth Embodiment

Figure 14:
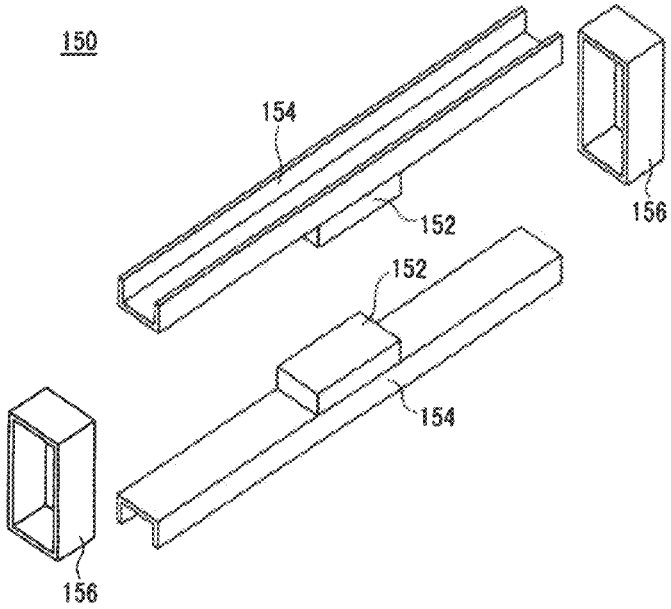
FIG. 14 is an exploded perspective view showing the plate-shaped holding system according to a fifth embodiment.
Figure 15:
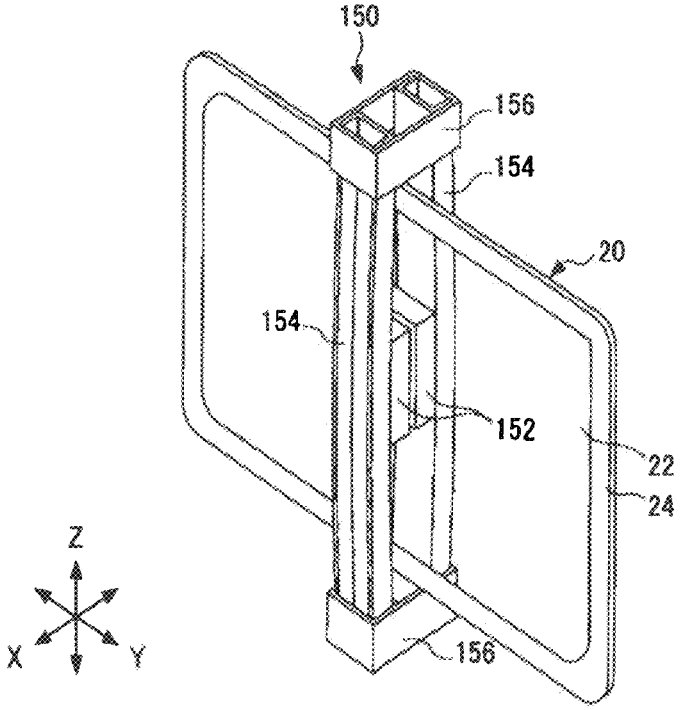
FIG. 15 is a perspective view showing how the plate-shaped holding system according to the fifth embodiment has been assembled.
Figure 16:
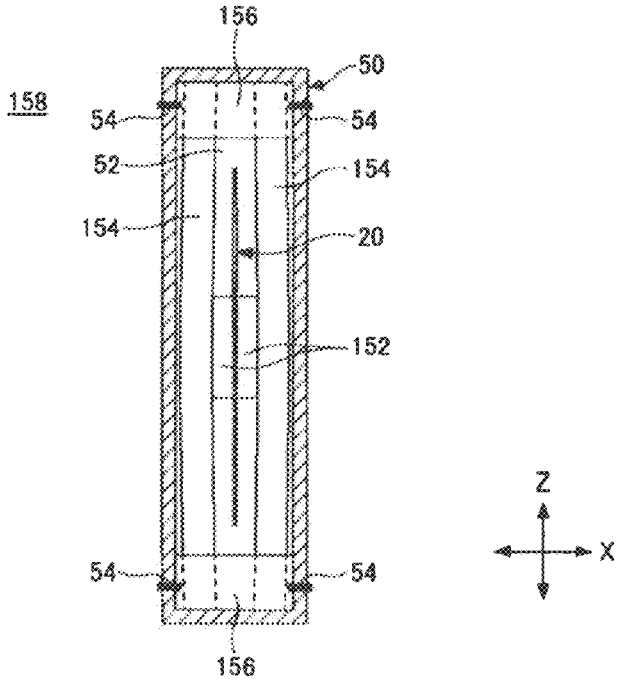
FIG. 16 is a vertical cross-sectional view showing a plate-shaped member packing device using the plate-shaped member holding system according to the fifth embodiment.
Figure 16:
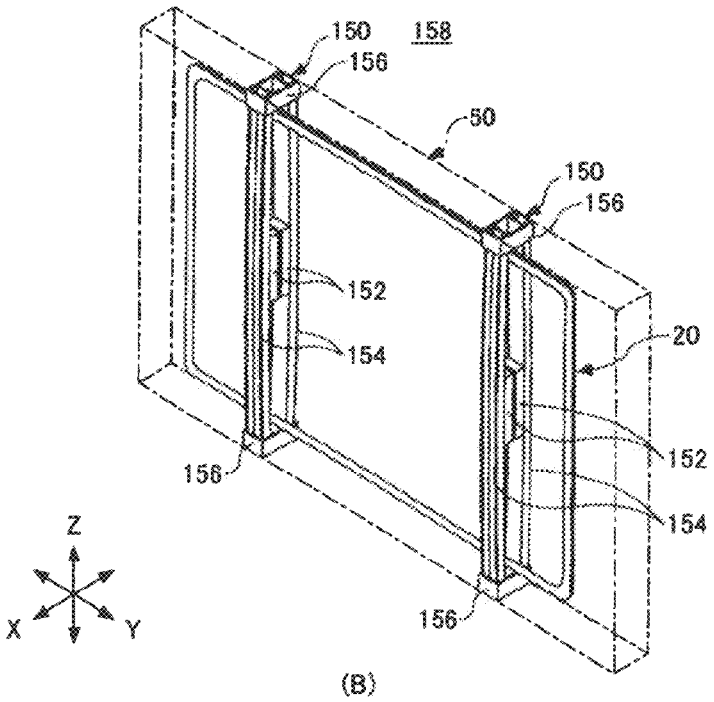

FIG. 14 is an exploded perspective view showing the plate-shaped member holding system according to a fifth embodiment. FIG. 15 is a perspective view showing how the plate-shaped member holding system 150 according to the fifth embodiment is assembled. FIGS. 16(A) and (B) are a vertical cross-sectional view and a perspective view, which show a plate-shaped member packing device using the plate-shaped member holding system 150 according to the fifth embodiment. In FIG. 14 through the FIGS. 16(A) and (B), parts similar or identical to the parts according to the above-mentioned embodiments are indicated by the same reference numerals, and explanation of those parts will be omitted.

As shown in FIG. 14, the plate-shaped member holding system 150 according to the fifth embodiment includes a pair of retainers 152, a pair of holders 154, and a pair of couplers 156. The retainers 152 are stuck to intermediate portions of the holders 154 in longitudinal directions of the holders so as to be brought into contact with both sides of the glass surface of a glass sheet 20. Each of holders 154 is formed of a compressed paper material in a bar shape having a U-character shape in section, having an increased strength in comparison with a general-purpose corrugated cardboard. Each of the couplers 156 is formed of a rectangular frame made of, e.g. a corrugated cardboard.

As shown in FIG. 15, the plate-shaped member holding system 150 is assembled so as to bring the paired retainers 152 into contact with a front side and a rear side of the glass surface 22 of the glass sheet 20 by bridging the paired holders 154 in parallel so as to extend along the glass surface of the glass sheet 20. Ends of the paired holders 154, which project outside the peripheral edge 24 of the glass sheet 20, are engaged with the couplers 156 to couple the paired holders 154. In this manner, the paired holders 154 generate pressing forces to press the paired retainers 152 in directions to bring the retainers closer to each other by the couplers 156 engaged with the ends of the paired holders. Accordingly, the paired retainers 152 are flexed so that the corresponding ends of the paired holders 154, which are disposed in parallel, are brought closer to each other by the couplers 156. This flexure causes elastic deformation, providing the retainers 152 with holding forces for holding the glass sheet 20. As a result, the glass surface 22 of the glass sheet 20 is clamped from both sides by the retainers 152.

The couplers 156 serve as supports for supporting the glass sheet 20 in an upright position even in a stage before housing the glass sheet 20 in a box 50.

As shown in FIG. 16(A), the couplers 156 fasten the ends of the paired holders 154. When the glass sheet is housed into the box 50, the holders 154 slide on the inner walls of the box 50, guiding the glass sheet 20 into the box. After the glass sheet 20 is housed in the inner space 52, the holders are engaged with the upper portion and the bottom portion of the box 50 to stably hold the glass sheet 20. For example, the couplers 156 are engaged with an upper portion and a lower portion of the inner space 52 of the box 50 and are fixed to the box 50 by fastening members 54 in this embodiment. In this manner, the plate-shaped member packing device 156 using the plate-shaped member holding system 150 is mounted to the glass sheet 20 so as vertically extend with respect to the glass sheet. As a result, the ends of the paired holders 154 are fixed to the box 50 through the couplers 156, stably and firmly holding the glass sheet 20 in the inner space 52.

Each of the holders 154 and the couplers 156 according to the fifth embodiment may be formed of a paper material, such as a corrugated cardboard. After taking the glass sheet 20 out of the box 50, it is possible to easily reuse the holders and the couplers along with the box 50 as recycle materials by recovering the holders and the couplers along with the box by a recycle service.

For example, if the glass sheet 20 is of elongated shape in a horizontal direction and is heavy, it is preferred that plural (at least two) plate-shaped member holding systems 150 be used to hold the glass sheet 20 as shown in FIG. 16(B). In such a case, it is preferred that the plural plate-shaped member holding systems 150 be disposed so as to be as symmetrical with each other as possible. By this arrangement, it is possible to equally distribute the load to the respective plate-shaped member holding systems 150, preventing an excessive load from being applied to only one of the plate-shaped member holding systems 150.

Figure 17:
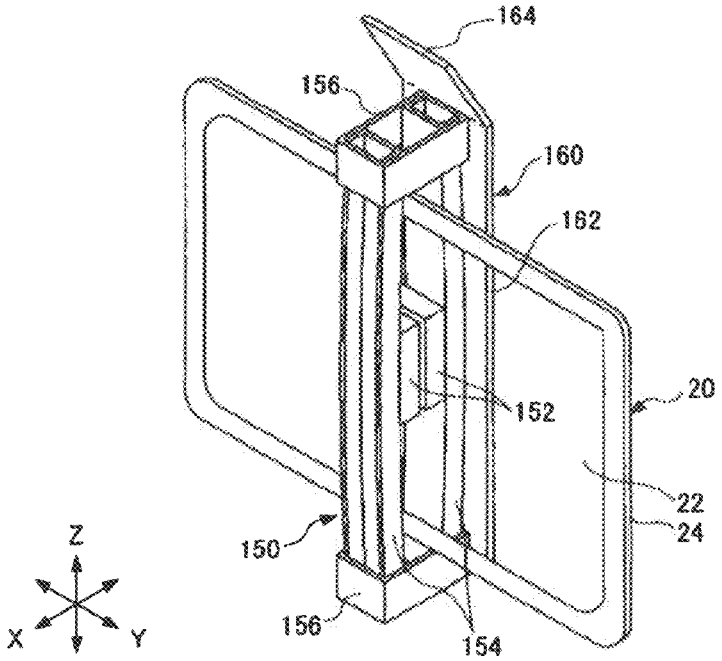
FIG. 17 is a perspective view showing a plate-shaped member packing device using the plate-shaped member holding system according to the fifth embodiment.
Figure 17:
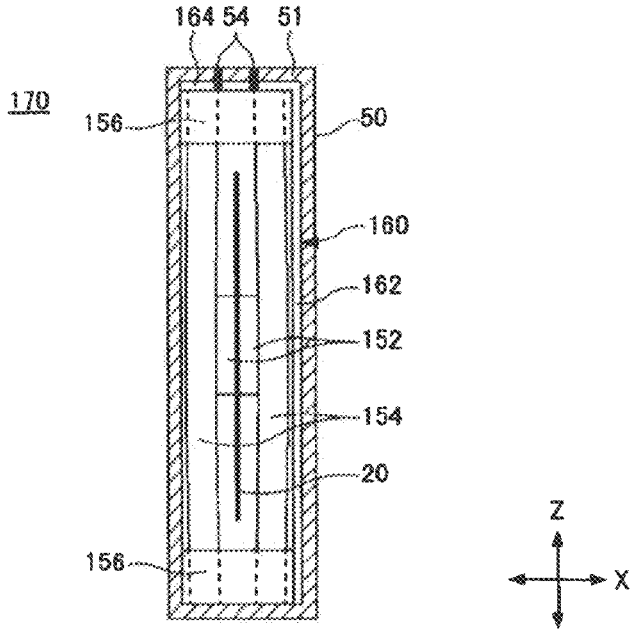

FIG. 17(A) is a perspective view showing a modification of the fifth embodiment. As shown in FIG. 17(A), the couplers 156 of the plate-shaped member holding system 150 according to this modification are coupled to a backboard 160 (formed of a corrugated cardboard), which is upright on the rear side of one of the holders 154.

In this modification, the respective upper and lower couplers 156 are coupled together, being fastened to the backboard 160, which is disposed in parallel with both holders 154 on the rear side of the one holder. The backboard 160 serves as a support when putting the glass board into the inner space 52 of the box 50.

The backboard 160 includes a supporting surface 162 for fastening the respective couplers 156 thereto, and a flap 164, which is prepared by folding an upper portion of the supporting surface 162 in a horizontal direction. When the glass sheet 20 is housed and packed in the inner space 52 of the box 50, the glass sheet 20 is held by the plate-shaped member holding systems 150, which are fastened to the backboard 160. Accordingly, the glass sheet 20, which is held by the plate-shaped member holding system 150, can be put into the box 50, as it is, through the upper opening of the box 50, as it is, by holding the flap 164.

The backboard 160 may be formed of a folded corrugated cardboard. The backboard may be formed in a different shape from the above-mentioned shape. It is possible to easily reuse the backboard along with the box 50 as recycle materials after use.

In accordance with a plate-shaped member packing device 170 using the plate-shaped member holding system 150 and the backboard 160 as shown in FIG. 17(B), it is possible to easily perform a packing operation by holding the backboard 160.

The flap 164 is folded at an angle of 90 degrees to close the opening of the box 50, and the flap 164 is fastened to a lid 51 of the box by fastening members 54, such as staples, in such a state that the lid 51 is overlapped with the flap 164.

By fastening the flap 164 of the backboard 160 to the box 50 as described above, the plate-shaped member holding system 150 for holding the glass sheet 20 is stably supported so as to be prevented from leaning or wobbling. Thus, the glass sheet 20 is reliably held since the glass sheet is prevented from being shifted even if vibration or a shock is applied to the glass sheet during transportation.

The plate-shaped member holding system 150 housed in the box 50 is supported by the backboard 160, having the upper and lower couplers 156 engaged with the box 50, and the backboard 160 is fastened to the box 50. Thus, the glass sheet is held so as to be prevented from wobbling even if vibration is applied in a front-to-rear direction, a left-to-right direction or a vertical direction.

When taking out the glass sheet 20 after delivery, it is possible to take out the glass sheet 20 and the plate-shaped member holding system 150 fastened to the backboard 160 by holding the flap 164 and drawing the backboard 160 out of the box 50. Thus, it is possible to easily take out the glass sheet 20 by using the backboard 160 to support the plate-shaped member holding system 150.

Figure 18:
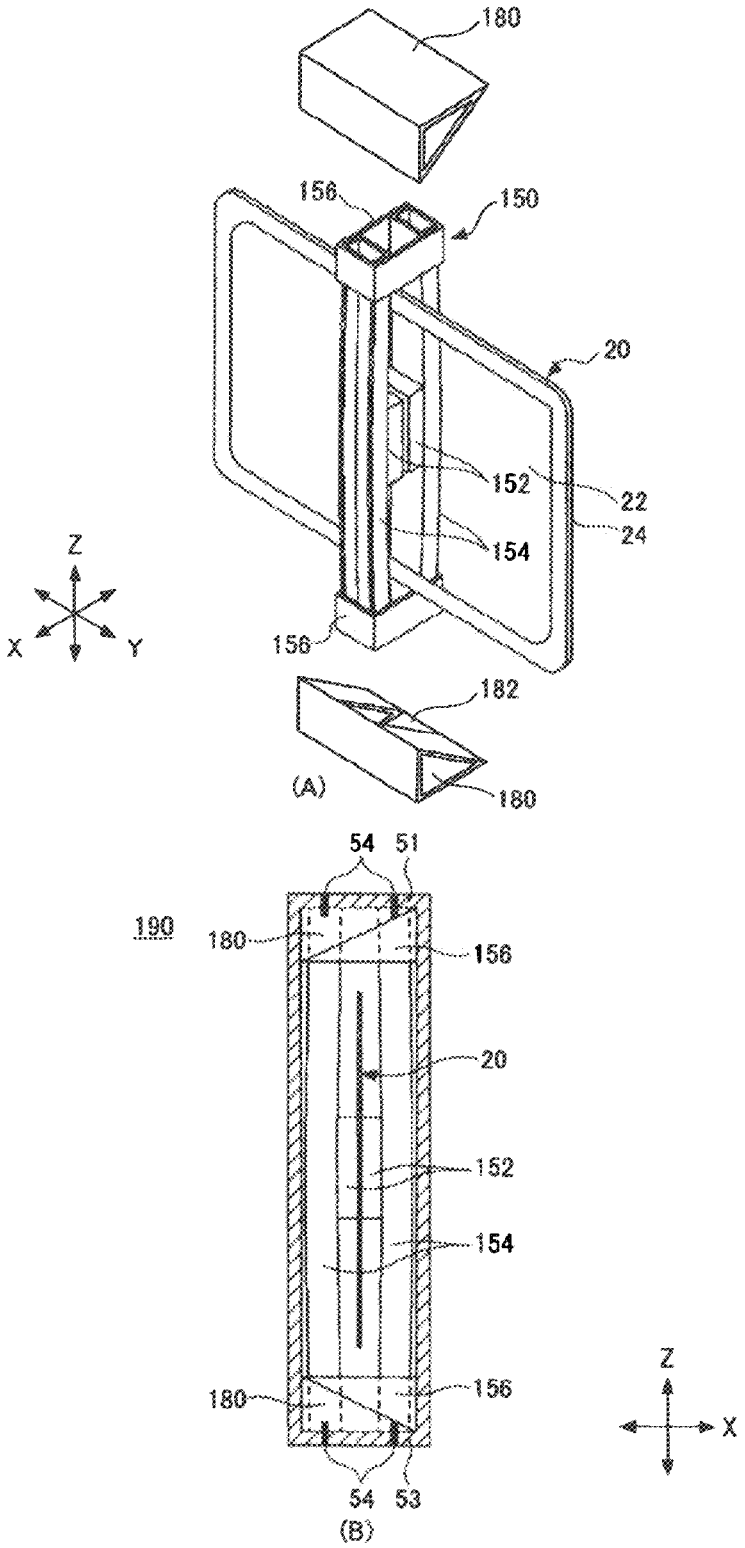
FIG. 18 contains views showing a plate-shaped member packing device using the plate-shaped member holding system according to the fifth embodiment

FIG. 18(A) is an exploded perspective view showing a second modification of the fifth embodiment. FIG. 18(B) is a vertical cross-sectional view showing a plate-shaped member packing device using the second modification of the fifth embodiment.

As shown in FIG. 18(A), the plate-shaped member packing device 190 according to the second modification is configured so that the couplers 156 of the plate-shaped member holding system 150 are engaged with engagement portions 182 of auxiliary members 180. The auxiliary members 180 are configured so as to have a wider width than the couplers 156 in a left-to-right direction and to have an area of about three times of the couplers 156 in a top side and a bottom side thereof. Thus, the auxiliary members 180 stably support the plate-shaped member holding system 150 by being engaged with the couplers 156 as shown in FIG. 18(B). Each of the auxiliary members 180 is formed of a folded corrugated cardboard formed in a triangular shape as seen from a lateral side, which can be recycled as in the other parts.

When the plate-shaped member holding system 150 is configured to assemble the auxiliary members 180 to the couplers 156, the auxiliary member 180 can be engaged with the inner wall of the box 50, supporting the plate-shaped member holding system 150 in an upright position in the inner space 52 as shown in FIG. 18(B). Thus, it is possible to firmly hold the glass sheet 20 without wobbling even if vibration is applied from any direction of a front-to-rear direction, a left-to-right direction and a vertical direction during transportation.

In the plate-shaped member packing device 190 including the plate-shaped member holding system 150 and the auxiliary members 180, the auxiliary members 180 are fastened to the lid 51 and the bottom 53 of the box 50 by fastening members 54. Since the auxiliary members 180 for holding the upper and lower ends of the plate-shaped member holding system 150 are unified with the box 50, and since the plate-shaped member holding system 150 are fastened to the lid 51 through one of the auxiliary members 180 in this manner, the plate-shaped member holding system 150 can be supported without shifting or leaning.

When taking out the glass sheet 20 after delivery, it is possible to draw the plate-shaped member holding system 150 out of the box 50 by holding the plate-shaped member holding system, since the couplers 156 are not fixed to the inner wall of the box 50. Since the plate-shaped member holding system 150 is separated from the auxiliary member 180 on the bottom by this operation, it is possible to easily take out the glass sheet 20.

Each of the auxiliary members 180 is formed of a folded corrugated cardboard. Each of the auxiliary members may be formed in a shape other than a triangular shape (such as a rectangular shape). It is possible to easily reuse the auxiliary members along with the box 50 as recycle materials after use.

Although explanation has been made about a case where each of the holders 54 is shaped in a U-character shape in section, each of the holders is not limited to have such a shape. Each of the holders may be formed in any shape in section, such as a circular or angular tubular shape in section, an L-character shape in section, a V-character shape in section, a figure-of-eight shape in section, or a combination thereof. Each of the holders 154 may have a cross-sectional shape changing in the longitudinal direction thereof according to a desired mechanical strength.

Although explanation has been made about a case where each of the fastening members 54 is formed in an angular tubular shape, each of the fastening members is not limited to have such a shape. The fastening members may have a different shape according to the shape of the holders 154. The fastening members may be formed of an adhesive tape, an adhesive, such as a hot melt, or any other fastening material.

Although explanation of this embodiment has been made about a case where the plate-shaped member holding system 150 is fixed to the backboard 160, the plate-shaped member holding system 150 may be fixed directly to the box 50 without using the backboard. The backboard 160 and the flap 164 may be prepared as separate members. It is acceptable to use a backboard 160 having no flap 164.

Although explanation has been made about a case where the plate-shaped member holding system 150 and the backboard 160 have a substantially equal width each other, the backboard 160 may have a wider width in order to be stabilized in the inner space 52. The fastening of the backboard 160 and the flap 164 to the plate-shaped holding system 150 and the box may be made at plural locations, as required, by use of the fastening members 54. Each of the fastening members 54 may be formed of an adhesive tape, an adhesive, such as a hot melt, or any other fastening material.

INDUSTRIAL APPLICABILITY

Although explanation of the above-mentioned embodiments have been made about in a case where the plate-shaped member holding system and the plate-shaped member packing device are used to pack a plate-shaped member formed of a glass sheet, the present invention is not limited to such an application. The present invention is also applicable to hold a plate-shaped member other than a glass sheet, which is formed of a material susceptible to vibration or a shock, or which is preferably transported without having a peripheral portion brought into contact with anything (such as a liquid crystal substrate, a substrate for a plasma display or a metal plate).

Although explanation of the above-mentioned embodiments has been made about a case where each of the retainers 32 or 152 is formed of an elastic member, the present invention is not limited to such a case. For example, when a plate-shaped member is formed of a material having a high surface hardness and unsusceptible to a scratch, such as a metal sheet, each of the retainers 32 or 152 may be formed of a corrugated cardboard. In such a case, it is possible to reuse the retainers 32 or 152 as recycle materials.

The entire disclosure of Japanese Patent Application No. 2006-117131 filed on Apr. 20, 2006 including specification, claims, drawings and summary is incorporated herein by reference in its entirety.

What is claimed is:

1. A plate-shaped member holding system comprising:

a plate-shaped member;

a holder including a pair of retainers configured to clamp the plate-shaped member from both sides of a front side and a rear side thereof and a pair of supports configured to support the retainers, the pair of supports having outer side portions; and a fixing member comprising an engagement recess engageable with the supports, the engagement recess having inner contacting surfaces;

the pair of supports being configured to be pressed in directions to be brought closer to each other in a course of being put into the engagement recess, whereby the pair of retainers are configured to hold the plate-shaped member from both sides of the front and rear sides, and wherein the front side and the rear side of the plate-shaped member have peripheral edges and the holder, including the retainers, does not touch the peripheral edges of the front and rear sides of the plate-shaped member when the retainers clamp the plate-shaped member.

2. The plate-shaped member holding system according to claim 1, wherein the pair of supports form a tapered portion configured to be brought into contact with inner contacting surfaces of the engagement recess, and wherein the pair of retainers are configured to be pressed in directions to be brought closer to each other by utilizing a relative difference between a distance between the pair of supports before and after engagement with the engagement recess and a relative contacting angle between the contacting surfaces and a thickness of the tapered portion.

3. The plate-shaped member holding system according to claim 2, wherein outside surfaces of the tapered portion are inclined at a first angle greater than zero degrees with respect to the front side of the plate-shaped member held by the pair of retainers, and wherein said contacting surfaces of the engagement recess are inclined at a second angle greater than zero degrees with respect to the front side of the plate shaped member.

4. The plate-shaped member holding system according to claim 3, wherein the first angle is greater than the second angle.

5. The plate-shaped member holding system according to claim 1, wherein the fixing member is configured to be fixed in a package including a space for housing the plate-shaped member.

6. The plate-shaped member holding system according to claim 1, wherein each of the holders and the fixing member is formed of a folded corrugated cardboard assembled in a shape, and wherein the holders and the fixing member have respective folded portions configured to be developed in a flat shape.

7. The plate-shaped member holding system according to claim 1, wherein the holder is configured to generate pressing forces to press the pair of retainers to bring the pair of retainers closer to each other for holding the plate-shaped member by utilizing a weight of the plate-shaped member to engage the pair of supports with the engagement recess of the fixing member, whereby the pair of retainers are provided with a holding force.

8. A plate-shaped member packing device comprising the plate-shaped member holding system defined in any one of claims 1-5, 6 and 7, the plate-shaped member holding system being configured to be disposed on at least one side of the plate-shaped member and to be fixed to a box for housing the plate-shaped member.

9. The plate-shaped member holding system according to claim 1, wherein a part is mounted to the peripheral edges of the front and rear sides of the plate-shaped member, and the holder is configured so that the holder, including the retainers, does not touch the part during transport of the plate-shaped member.

10. The plate-shaped member holding according to claim 9, wherein the part is a deformable molding.

11. The plate-shaped member holding system according to claim 1, wherein the fixing member is reinforced by a rectangular parallelepiped reinforcing member engaged with outer lateral sides of the fixing member in four directions, in order to be prevented from being deformed outward.

12. The plate-shaped member holding system according to claim 1, wherein the holder has a guide member disposed on a rear side of a portion thereof with the retainer of one of the supports disposed therein.

13. A plate-shaped member holding system comprising:

a plate-shaped member;

a holder including a pair of retainers configured to clamp the plate-shaped member from a front side and a rear side thereof and a pair of supports configured to support the retainers; and a fixing member comprising an engagement recess engageable with the pair of supports, the engagement recess having inner contacting surfaces, wherein the pair of supports are configured to be pressed closer to each other in a course of being put into the engagement recess, and wherein the pair of retainers are configured to hold the plate-shaped member from both the front and rear sides, wherein the fixing member and holder together include means for holding the plate-shaped member so that peripheral edges of the front and rear sides of the plate-shaped member do not touch the holder, including the retainers.

14. The plate-shaped member holding system according to claim 13, wherein the plate-shaped member has a part mounted to the peripheral edges of the front and rear sides of the plate-shaped member, and the holder is configured so that the holder, including the retainers, does not touch the part during transport of the plate-shaped member.

15. The plate-shaped member holding according to claim 14, wherein the part is a deformable molding.

16. The plate-shaped member holding system according to claim 13, wherein the holder and fixing member together, by utilizing a weight of the plate-shaped member, include means for generating pressing forces to press the pair of retainers closer to each other for holding the plate-shaped member.

17. The plate-shaped member holding system according to claim 13, wherein each of the holders and the fixing member is formed of a folded corrugated cardboard assembled in a shape.

* * * * *